US005851061A

United States Patent [19]

Hegarty

[11] Patent Number: 5,851,061

[45] Date of Patent: Dec. 22, 1998

[54] RECESSED EMERGENCY LIGHTING WITH MOVABLE MIRROR

[75] Inventor: William Hegarty, 213 Columbia La., Stevensville, Md. 21666

[73] Assignee: William Hegarty, Stevensville, Md.

[21] Appl. No.: 811,870

[22] Filed: Mar. 5, 1997

[51] Int. Cl.[6] ..... F21V 19/04

[52] U.S. Cl. ..... 362/20; 362/147; 362/284; 362/324

[58] Field of Search ..... 362/20, 64, 137, 362/145, 147, 154, 155, 276, 282, 284, 322, 324, 375, 802

[56] References Cited

U.S. PATENT DOCUMENTS

| | | | |
|---|---|---|---|
| 1,847,324 | 3/1932 | Adams | 362/284 |
| 4,367,514 | 1/1983 | Large et al. | 362/62 |
| 4,443,836 | 4/1984 | Horiuchi et al. | 362/64 |
| 4,482,939 | 11/1984 | Tishman | 362/64 |
| 4,708,223 | 11/1987 | Orndorff et al. | 362/20 |
| 4,802,065 | 1/1989 | Minter et al. | 362/20 |
| 5,025,349 | 6/1991 | Gow | 362/20 |

*Primary Examiner*—Alan Cariaso
*Attorney, Agent, or Firm*—Eckert Seamans Cherin & Mellott, LLC

[57] ABSTRACT

An emergency lighting fixture which is recessed within a wall or ceiling is disclosed. The emergency lighting fixture is contained within a housing which is installed into a cavity within the wall or ceiling. During the normal operation of the primary lighting system the emergency lighting fixture remains concealed by a panel which is flush with the wall or ceiling. The panel is attached to the housing by hinges and has a mirrored rear surface. Located within the housing is a high intensity halogen lamp and a solenoid piston assembly. Upon the failure of the primary lighting system the solenoid actuates the arm of the piston opening the panel which activates the halogen lamp. The halogen lamp produces a high intensity beam of light which is reflected by the mirrored rear surface of the panel illuminating the desired area.

15 Claims, 5 Drawing Sheets

RECESSED EMERGENCY LIGHTING WITH MOVABLE MIRROR

BACKGROUND OF THE INVENTION

1. Field of the Invention

The invention generally relates to lighting fixtures, especially for emergency lighting systems, security lighting and similar short term or temporary lighting needs. At least one stationary high intensity lamp, and preferably a pair of lamps, is mounted in a housing that can be recessed in a wall or ceiling. A hinged panel with a mirror normally covers the housing and can be opened by a solenoid when the lamp is powered, e.g., from a battery or other auxiliary source, to reflect a beam in a direction useful for illuminating an interior or exterior area.

2. Prior Art

Secondary or supplemental lighting provides illumination when primary lighting systems fail to operate, or temporarily supplements primary lighting by adding to the illumination of a particular area when needed due to the occurrence of some contingency. Primary lighting systems are typically coupled directly to the power mains. Supplemental lighting systems are often powered by storage batteries that are charged from the mains when power is available, and are switched over to power supplemental lamps when a loss of primary power occurs.

Supplemental lighting systems may be useful in other temporary lighting situations as well. As appropriate, the supplemental lighting can be battery powered or powered from the power mains. For example, supplemental lighting may be provided for a secure zone in or around a building, and only switched on when a particular event occurs, such as when an incursion is detected. Such supplemental lighting systems may be used temporarily and only infrequently. Therefore, the supplemental lighting system is advantageously made inconspicuous and placed clear of active areas. However, the supplemental lighting system must stand ready to be deployed.

An example of a supplemental lighting system is an emergency indoor lighting system to assist in evacuation. For example in the case of a fire, the power distribution circuits may be accidentally or deliberately opened, and secondary emergency lighting may be needed for the occupants to see their way to evacuate safely. Public places and interior building spaces without windows to let in external lighting are generally required by building codes to provide emergency lighting such as illuminated exit signs as well as supplemental lighting systems for illuminating emergency exit paths.

Typical emergency lighting systems comprise fixtures mounted high on a wall or ceiling, for example having a box-like housing bolted to the surface of the wall or ceiling. The fixtures have one or more lamps to direct light outwardly and downwardly into the area to be illuminated, or across the surface of the wall or ceiling to illuminate the area indirectly. A battery is contained in the housing together with a battery charging and control circuit coupled between the power mains and one or more lamps. When power fails, battery power is switched to the lamps through a relay, diode or similar known switching arrangement.

Typical surface mounted emergency lighting fixtures have relatively high malfunction rates. One reason for failure is damage to the exposed lamps. The fixtures need to be located in the area to be illuminated and preferably are reasonably accessible for maintenance. However, their accessibility and exposure make the lamps subject to accidental damage and in some cases vandalism involving breakage of the lamp bulb or interference with the battery or its connections. The danger of damage is most acute for temporary lighting fixtures that have a security function, such as external lighting for warehouses, loading docks and the like.

To reduce vulnerability to damage, emergency lighting systems can be mounted wholly or partly in protective enclosures. Protective enclosures may not be apt in the case of high intensity bulbs or high wattage lighting having a number of lamp bulbs, because the temperature builds up in the enclosure when the lamps are powered. Operation at high temperatures can cause incandescent bulbs to fail prematurely. Some high intensity bulbs such as halogen bulbs become quite hot and require ventilation and/or thermal insulation.

It is possible to provide a partial enclosure such as a wire cage around the lamps to protect the lamps against most accidental damage while permitting heat to escape when the lamps are on. However, a partial enclosure permitting adequate ventilation may be ineffective against a determined thief or vandal.

A further consideration is aesthetic appeal. The typical box-like fixture having protruding lamp bulbs, particularly if a protective enclosure is provided, lacks aesthetic appeal. It would be advantageous if such lighting fixtures could be made more appealing, for example as appropriate to the interior of an office building where some expense has been incurred to establish a pleasing decor. However, there is a need to improve the aesthetics without undue expense or complication, and without causing problems with vulnerability and temperature build up.

An alternative to mounting an emergency lighting system on the surface of a wall or ceiling is to recess all or part of the fixture in the wall or ceiling. This is somewhat more complicated than surface mounting but has benefits. The recessed mounting conceals all or part of the emergency lighting fixture, can protect lamps from being vandalized or damaged, and is aesthetically unobtrusive.

Nevertheless, there are drawbacks involved with recessed lighting, not limited to the potential for temperature build up. In the case where the lamps are recessed, the emitted light, which is directed outwardly from the recess, tends to illuminate a smaller area than comparable exposed lighting fixtures. Whereas less light may be directed effectively, higher intensity lamp bulbs or more lighting fixtures may be needed in a given area to achieve the same illumination as an exposed lighting system. Lenses, prisms or shades can redirect light, but may either confine heat or require a protruding structure that is little improvement over a surface mounted fixture.

In U.S. Pat. No. 5,025,349—Gow, an attempt is made to improve the light emission of a recessed lighting fixture by use of a motor drive assembly that extends the lamps of a battery powered emergency lamp fixture out of a usual recessed position to protrude when the lamps are activated. This allows Gow to illuminate a larger area and/or at greater intensity than with a fixed recessed lamp. When power is restored, the emergency lamp is retracted into the recessed position, concealing it from view and protecting it from damage.

The movable lamp fixture of Gow is aesthetically appealing and prevents damage to the emergency lamps when retracted, but has shortcomings. An electric motor and gear arrangement is somewhat complicated and expensive. When opening or closing the fixture, the motor is operated until the movable structure operates limit switches, which requires a relay control circuit. If the motor and gears should malfunction or jam, the lamp remains in its retracted position and fails to illuminate the intended area at all. The emergency lamp and motor remain powered. If high intensity lamps are used, such as halogen lamps, Gow's arrangement will require open ventilation to prevent overheating, but if stuck in the retracted position there is a danger of overheating. A further problem is due to the fact that electric lamps can be delicate and subject to vibration damage, especially when hot. Lamp filaments can break or become detached from their electrical connections in movable lamp devices. It would be advantageous if lamps in a recessed light fixture could be effectively advanced to an exposed position and retracted in a dependable manner that minimizes vibration and provides substantially as much illumination as a fixture in which the lamps are fixed at an exposed position.

SUMMARY OF THE INVENTION

It is an object of the invention to provide a temporary or emergency lighting fixture which has a high intensity lamp mounted at a fixed retracted position, covered by at least one movable reflecting mirror so that when the lamp is activated the mirror is moved to direct light from the lamp in a useful laterally outward direction.

It is a further object of the invention to provide an emergency lighting fixture which normally is aesthetically concealed and protected from accidental damage and vandalism, and which is not subject to heat buildup when activated or vibration from movement.

These and other objects are accomplished by an emergency lighting fixture which is recessed in a mounting element and can be flush mounted in a wall or ceiling. The fixture has fixed lamps in a housing, covered and concealed behind a movable panel that normally is flush with the mounting element. The panel can be hinged to the housing and has a reflective rear surface, preferably mirrored. The lamp can be a high intensity lamp such as a halogen lamp. A solenoid is coupled between the housing and a point on the panel spaced from the hinge axis, and is controllably operable to pivot the reflective panel into an open position in which light from the lamp is reflected so as to be directed partly laterally, such as outwardly over the surface of the ceiling or wall. The solenoid can be activated by a control circuit that simultaneously applies power to the lamp. The invention is applicable to battery powered temporary lighting or to lighting that is powered from the power mains.

Other objects, advantages and novel features of the present invention will become apparent from the following detailed description of the invention when considered in conjunction with the accompanying drawings.

BRIEF DESCRIPTION OF THE DRAWINGS

For the purpose of illustrating the invention, the drawings show an exemplary embodiment of the invention as presently preferred. It should be understood, however, that the invention is not limited to the precise arrangements and instrumentalities shown, and is capable of variation within the scope of the appended claims.

DETAILED DESCRIPTION OF THE PREFERRED EMBODIMENTS

Figure 1:
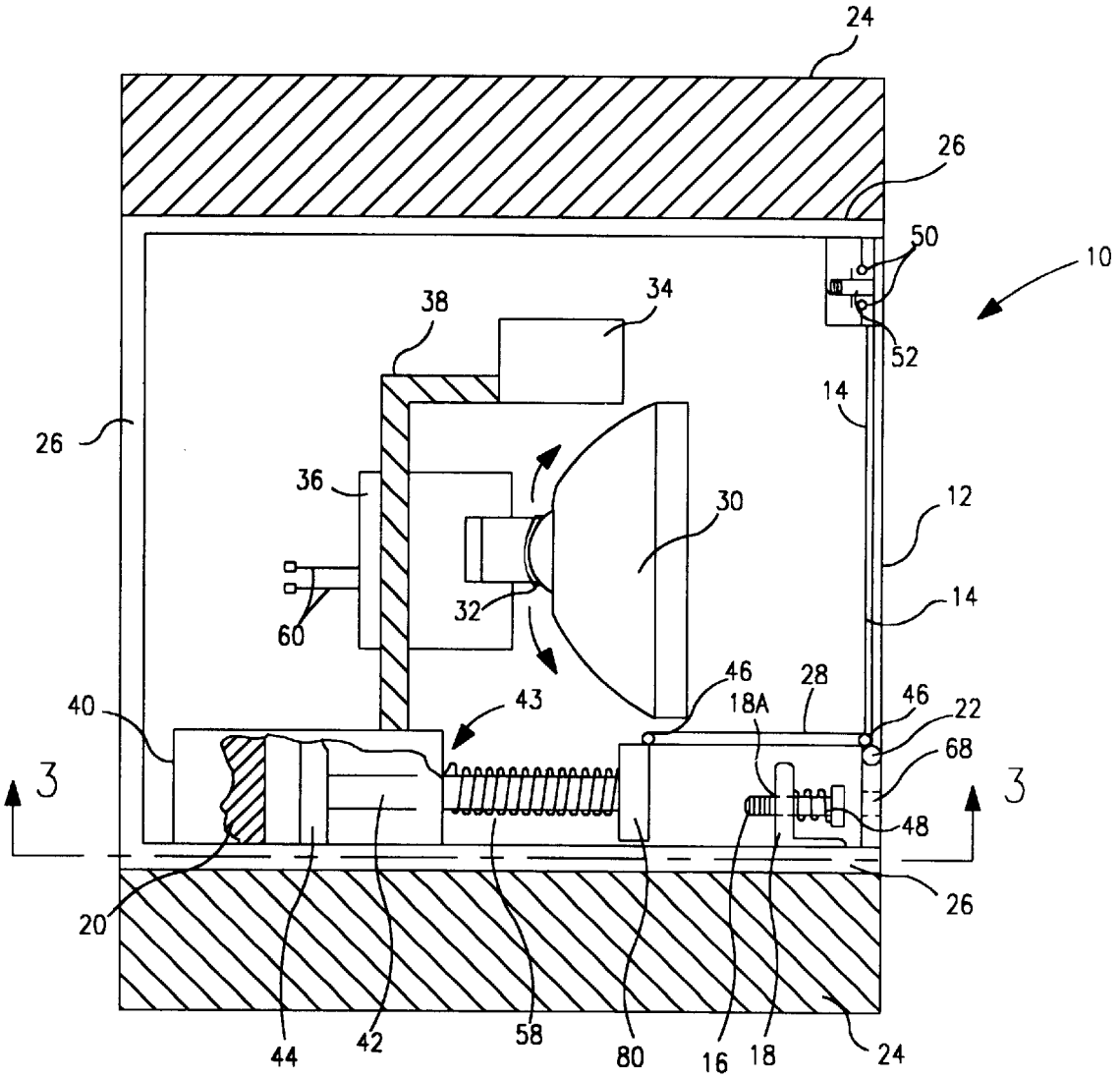
FIG. 1 is a top sectional view of the emergency or temporary light fixture of the invention in its protected or deactivated condition, wherein the covering panel is closed over the deactivated lamp.

Referring to the FIGS. 1–4, wherein the same reference numbers are used throughout to indicate the same elements, FIG. 1 shows a lighting fixture 10 installed in a mounting element 24 having an opening reaching flush with a surface. The mounting element can be formed in a wall or ceiling defining the surface, and FIG. 1 is a sectional view along a line parallel to the plane of the wall or ceiling. Lighting fixture 10 is placed in the mounting element 24 at a height and/or position in which illumination from lamp 30 in the fixture will be directed to the area in which the fixture is installed. However it is an aspect of the invention that the light from lamp 30 is directed not only along the centerline of a beam from the lamp, but also partly laterally.

Preferably, lighting fixture 10 is self contained in a box-like housing 26, and the housing is installed flush in mounting element 24, for example being attached to studs or other structural elements of the wall or ceiling. The fixture need not be self contained in a substantially closed housing 26 and could be installed directly in mounting element 24. Alternatively, a housing that is not closed on all sides could be provided.

The inside of housing 26 is covered and concealed by a panel 12 until fixture 10 is activated. Where fixture 10 is employed for emergency evacuation illumination, fixture 10 is activated when the primary lighting system fails, being triggered for example when power is lost on power mains that are coupled to both the primary lighting system and to fixture 10. In that event, a battery (not shown) that normally is being charged from the power mains, is switched over to power fixture 10 and lamp 30 in a known manner. Fixture 10 is also applicable to other lighting applications in which it is desirable for the fixture to be normally concealed and activated by such form of switch means as is appropriate. For example, the fixture can be a security lighting device activated by a manual switch, by a signal from a security system, by a signal from an incursion detection device, etc.

Panel 12 is mounted by hinges 22 at a proximal end of panel 12 to housing 26. When panel 12 is closed, lamps 30 remain deactivated. In order to ensure that lamps 30 remain deactivated, a limit switch or push button switch 52 can be mounted to the housing 26 so that the operator of the switch 52 protrudes against panel 12. Switch 52 is normally closed (i.e., closing the circuit when the operator is released), and is coupled in series with lamp 30. When panel 12 is closed it holds push button switch 52 in a position opening the circuit and de-coupling lamp 30 from the supply of power. When panel 12 is opened, switch 52 closes and activates lamp 30. Panel 12 can be opened automatically by operation of a magnetic latching solenoid 40, or optionally can be opened manually to activate lamp 30.

The rear surface of panel 12 has a reflective surface 14, which preferably covers the entire surface area of the rear of the panel 12 exposed to lamp 30. Reflective surface 14 can be any material which reflects a substantial proportion of incident light. In the preferred embodiment, reflective surface 14 comprises a fully reflective glass mirror. A part silvered mirror is also possible, or panel 12 can be partly translucent.

Figure 2:
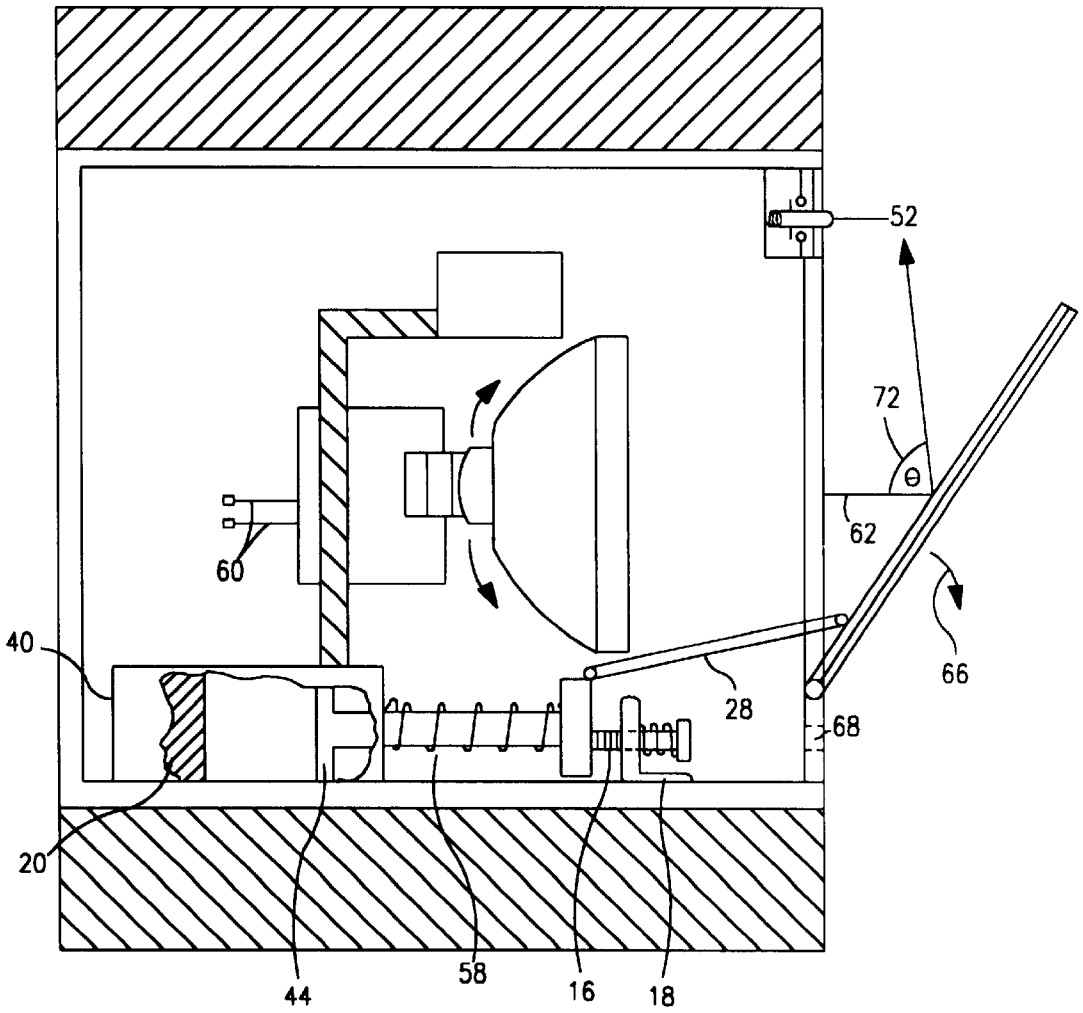
FIG. 2 is a top sectional view of the light fixture with the covering panel in an open position, reflecting a beam of light from the lamp laterally relative to the centerline of the beam.

As shown in FIG. 2, when fixture 10 is activated, panel 12 is opened, allowing push button switch 52 to close and activate lamp 30. Lamp 30 produces a beam of light 62, preferably a high intensity directed beam, which is incident on reflective surface 14 and is reflected at an angle 72. Lamp 30 remains stationary in housing 26, but due to reflection by the reflective surface 14 of panel 12 directs at least part of its illumination laterally relative to the original axis of beam 62. The lighting effect produced is similar to illumination that would be emitted by a lamp that was placed at the point of incidence of beam 62 on reflective surface 14, namely from a point spaced outwardly from the surface of the wall or ceiling. Whereas panel 12 is inclined from its closed position, some of the light from lamp 30 passes over the edge of panel 12 as well.

Whereas lamp 30 remains within housing 26, and housing 26 (or the space in the mounting element) is relatively closed, some heating occurs when lamp 30 is activated. However, panel 12 opens housing 26 substantially, allowing convective ventilation that is normally adequate for emergency lighting that is operated infrequently and for short times. In addition, undue heating can be eliminated by including a ventilating fan 34 directed onto or over lamp 30, coupled in parallel with lamp 30 such that the two are activated simultaneously.

Panel 12 can be opened automatically by a magnetic latching solenoid 40, which has a movable piston 43 connected to panel 12 at a space from its hinge axis by linkage 28. Piston 43 comprises a piston arm 42, a piston stop 80, and a plunger 44. Piston arm 42 is connected to the rear of panel 12 by linkage 28 so that as piston arm 42 is moved in an outward direction, panel 12 swings open. Linkage 28 is pivotally attached to arm 42 and panel 12, preventing linkage 28 from locking up.

A coil spring 58 is attached to the piston arm 42 between the casing of solenoid 40 and the piston stop 80, located distal to the plunger 44, so that the piston arm 42 is biased in an outward direction. Plunger 44 is magnetically drawn to the rear of solenoid 40 by a permanent magnet 20. When the fixture is inactive, permanent magnet 20 maintains spring 58 in a coiled or tensed state. When main power fails, solenoid 40 is energized at a polarity opposed to that of permanent magnet 20 such that their fields repel one another. This detaches plunger 44 from magnet 20, allowing spring 58 to release its stored energy, urging piston arm 42 outwardly and pivoting open panel 12. When main power is later restored, solenoid 40 is energized at a polarity matching that of magnet 20, to draw piston arm 42 and plunger 44 back against magnet 20. Plunger 44 is thereby attached magnetically to magnet 20, and piston arm 42 is moved inwardly to close panel 12. Retraction of arm 42 again tenses spring 58, biasing piston arm 42 in an outward direction for opening panel 12 in the event of a subsequent power loss.

Light beam 62 from lamp 30 has a certain diverging width. However with respect to its centerline, beam 62 is reflected at angle 72 by surface 14 when panel 12 is opened. The angle at which the reflected beam is directed depends on the angle to which panel 12 is opened. Opening panel 12 relatively wider increases deflection angle 72, provides a wider spread of light on wall or ceiling surfaces adjacent to fixture 10, and also allows more light to pass over the distal edge of panel 12 and pass directly outwardly without reflection.

The opening angle of panel 12 can be varied by controlling the actuation of panel 12 to the open position. This is accomplished by controlling the travel distance of piston arm 42. An adjustable screw 16 acts as a stop and is placed in a threaded aperture 18A of a mounting bracket 18 which is located in line with the path of the plunger of solenoid 40. A spring 48 between the head of screw 16 and mounting bracket 18, biases screw 16 axially. Once solenoid 40 releases plunger 44, the spring 58 uncoils and piston arm 42 travels outwardly until piston stop 80 contacts screw 16. Screw 16 is accessible through aperture 68 in order to lengthen or shorten the outward extreme of travel of piston arm 42. If set screw 16 is tightened, it protrudes further through aperture 18A shortening the travel distance of piston arm 42 and thus the degree to which panel 12 opens. If loosened, set screw 16 is drawn in an outward direction and piston arm 42 will be free to travel a the distance opening panel 12 wider. If the set screw 16 should become detached, then mounting bracket 18 will act as a stop.

Figure 5:
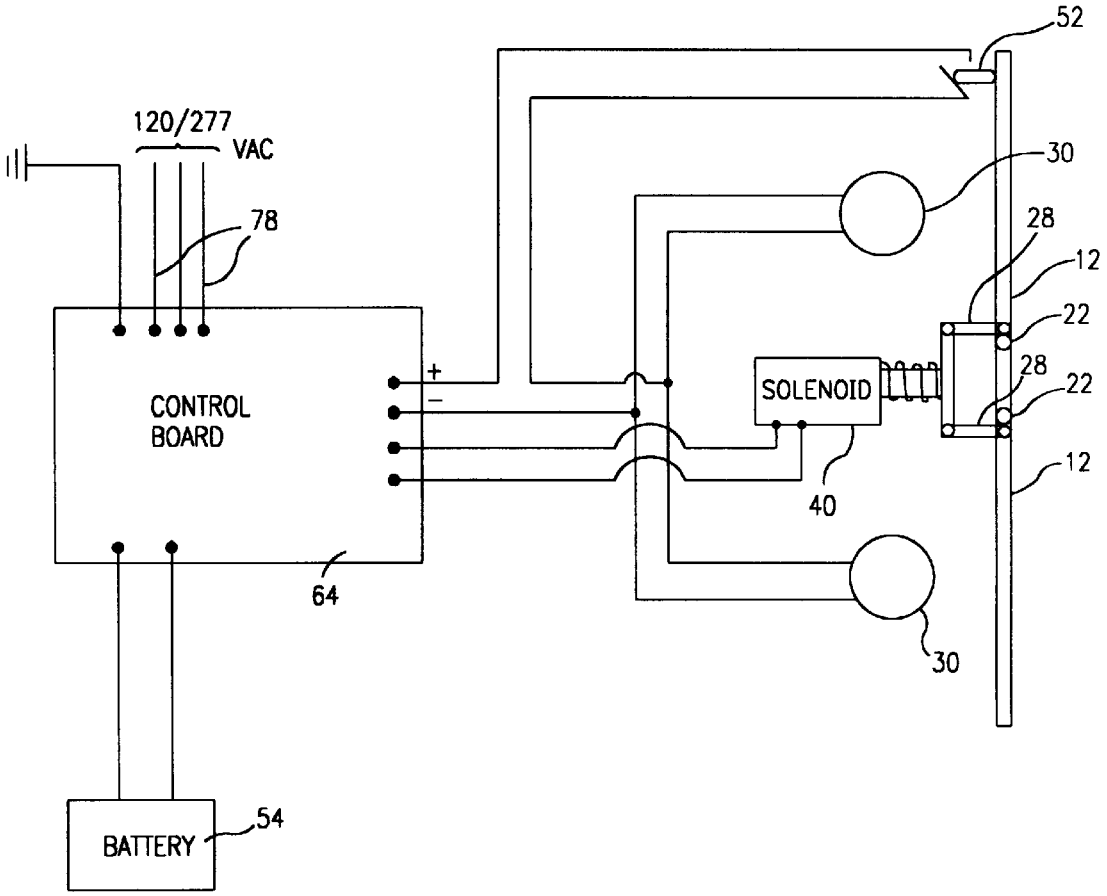
FIG. 5 is a functional block diagram showing electrical and control connections in accordance with the invention.

In the event of failure of solenoid 40 or inability to open panel 12, for example due to an external blockage, switch 52 prevents activation of lamp 30 and potential overheating of the lamp housing. The solenoid can be coupled to its power supply through a control device 64, shown generally in FIG. 5, whereas lamp 30 is coupled its power supply through switch 52. The power supply for the solenoid and the lamp can comprise a battery 54 in an emergency lighting system, normally charged through a voltage regulator located on control device 64 from the AC mains. The control device for the solenoid can be a relay or other switching device held by AC power to decouple the battery 54 from solenoid 40, thus powering the solenoid 40 when AC power is lost. Alternatively, the solenoid can be powered from some other form of control device such as an alarm system signal, a manual control or the like. Solenoid 40 can open panel 12 upon failure of the power source or upon a signal from another control device. If solenoid 40 does not operate, lamp 30 can be activated by manually opening panel 12.

Lamp 30 in housing 26 is surrounded by reflective skirting 38 which can form a parabolic reflector to redirect light in a collimated beam from lamp 30 to reflective surface 14. Lamp 30 can be mounted on a swivelling mount 32, which permits lamp 30 to be inclined toward or away from the hinge axis of panel 12, for additional adjustment of the angle at which light is directed outwardly and the proportion of light that is reflected versus the proportion directed outwardly.

For a given amount of battery capacity, halogen lamps provide high intensity as compared to incandescent "PAR" type lamps used in many designs. Halogen lamps and other high intensity lamps generate high temperatures, which exacerbates sensitivity to vibration. For this reason lamp 30 is retained in a substantially fixed position when in operation. The only range of motion which is permitted is pivoting of lamp 30 on swivel joint 32. This limited range of motion does not produce significant vibration and preferably is not accomplished in any event while the lamp is hot.

Figure 3:
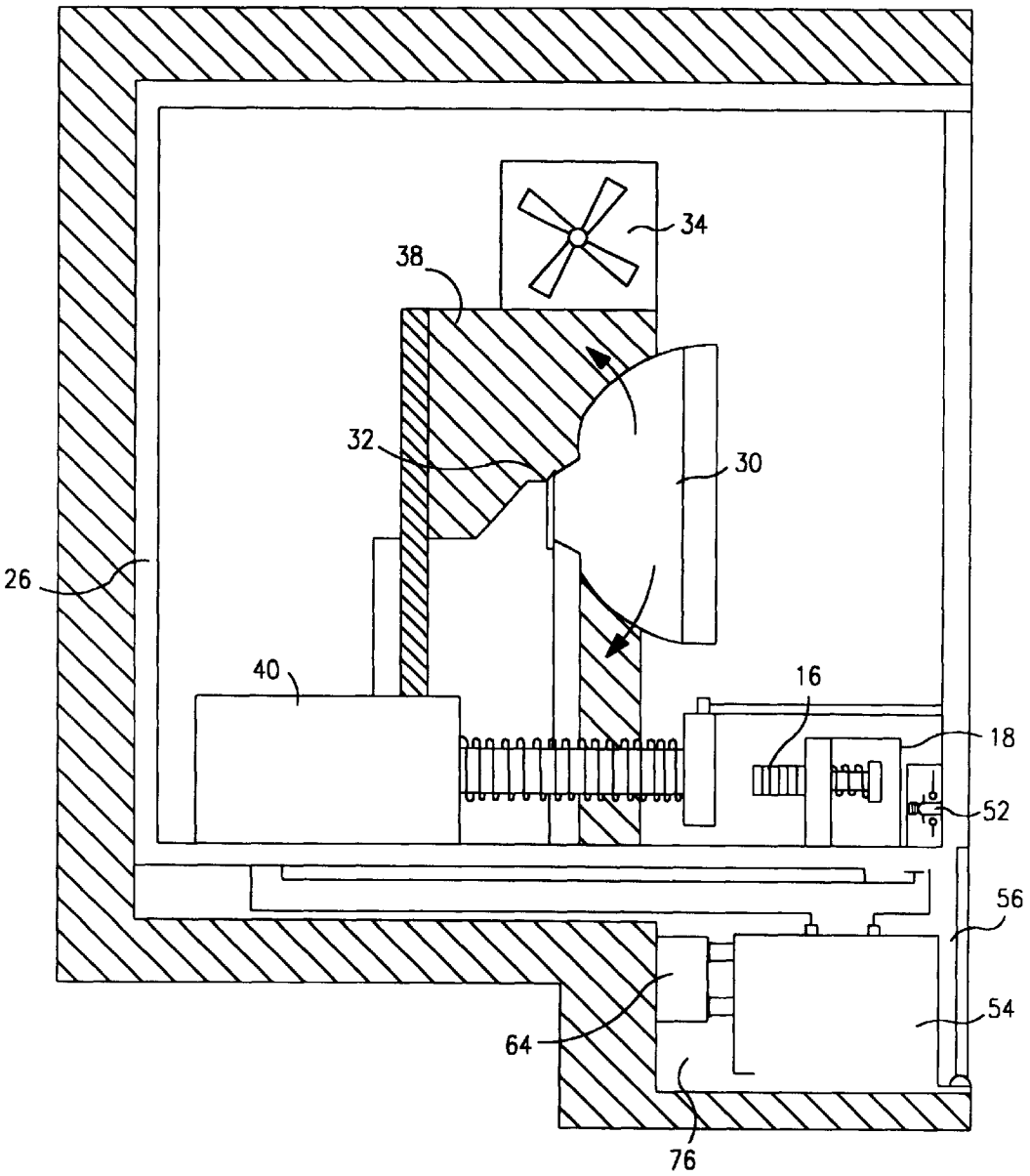
FIG. 3 is a section view, taken along line 3—3 of FIG. 1.

As embodied for an emergency evacuation light, fixture 10 can be powered by rechargeable battery 54. As shown in FIG. 3, battery 54 is located within housing 26 in a battery compartment 76 accessed through panel 56. Panel 56 can be opened for performance of maintenance activities such as changing battery 54. Battery 54 is charged and supplies power to lamp 30 by electrical connections shown in FIG. 5. During operation of the primary lighting system and availability of AC power, power mains 78 supply power to light fixture 10. The AC current is rectified and used to trickle charge battery 54 through a regulator located on control device 64.

Figure 4:
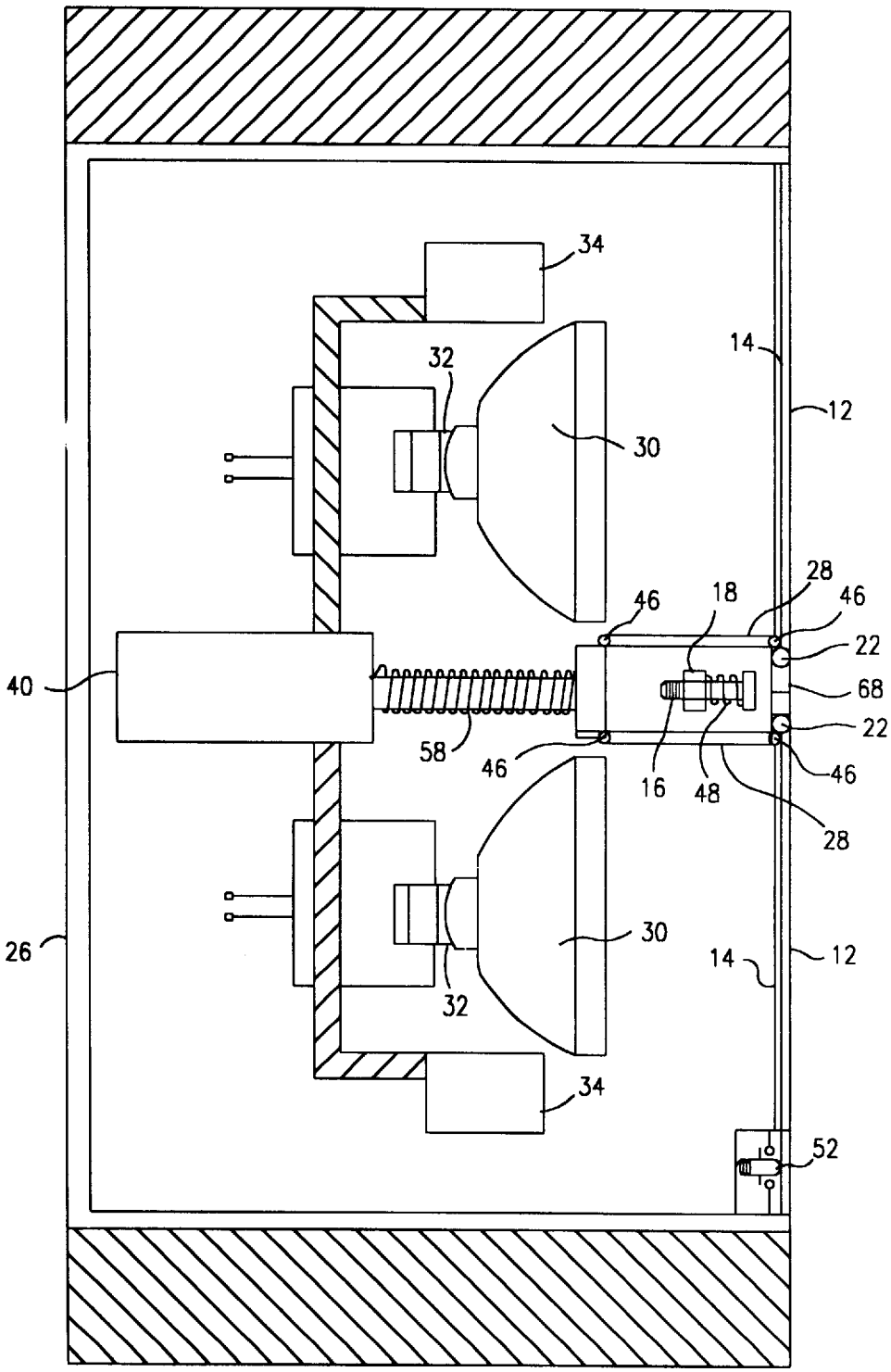
FIG. 4 is a top sectional view of a dual lamp configuration for the emergency or temporary light fixture of the invention in its deactivated condition, wherein the covering panels are closed over the deactivated lamp.

FIG. 4 shows a preferred arrangement in which two lamps 30 and two mirrors 14 are mounted in one configuration with their respective panels 12 placed such that their hinges 22 are on a side facing one another. This causes the light from the two lamps 30 to be directed laterally in opposite directions as the two panels 12 are opened. An array of four lamps in a cross having their lamps directed outwardly by panels at 90° intervals, or arrays of more lamps are possible, as is the basic configuration of a single lamp and panel.

Once the fixture is installed or otherwise coupled to a source of power, lamp 30 and battery 54 can be tested by opening panel 12 to activate lamp 30. Fixture 10 can be adjusted as needed to provide the desired level of illumination in the immediate area in which it is installed and in areas more distant. This is accomplished by horizontally or vertically tilting lamp 30 on swivel joint 32 and adjusting the degree to which panel 12 opens by adjusting set screw 16 as described above.

The invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalents which are also intended to be embraced therein.

I claim:

1. A lighting apparatus, comprising:

a fixed mounting element of a structure and a housing recessed in the mounting element, the mounting element being one of a floor, a wall and a ceiling;

a panel having a mirrored reflective surface on a rear face thereof, the panel being movably mounted on the housing so as to be movable between a covering position over an opening into the housing and an open position pivoted outwardly relative to the housing, the panel being substantially reflective;

means for pivoting the panel between the covering position and the open position;

a lamp disposed in the housing internally of said panel and for directing an illumination beam toward the panel; and, controlling means coupled between a source of electric power and said means for pivoting the panel, and between the source of electric power and the lamp, the controlling means being operable to concurrently activate the lamp and move the panel to the open position, such that light from the lamp is directed and diffused by the panel, outwardly from the recessed housing and in an area adjacent to the mounting element around the recessed housing.

2. A lighting apparatus disposed in a recessed housing in a mounting element, comprising:

a panel having an at least partly reflective surface on a rear face thereof, the panel being movably mounted on the housing so as to be movable between a covering position over an opening into the housing and an open position pivoted outwardly relative to the housing, the panel being at least partly reflective;

means for pivoting the panel between the covering position and the open position;

a lamp disposed in the housing internally of said panel and for directing an illumination beam toward the panel;

controlling means coupled between a source of electric power and said means for pivoting the panel, and between the source of electric power and the lamp, the controlling means being operable to concurrently activate the lamp and move the panel to the open position, such that light from the lamp is directed at least partly outwardly from the recessed housing by the panel; and wherein the apparatus is part of an emergency lighting system and wherein the controlling means comprises a switch operable to activate the lamp and move the panel to the open position upon failure of power in a primary lighting system.

3. The lighting apparatus of claim 2, wherein the source of electric power comprises a battery power source normally charged from the primary lighting system.

4. The lighting system of claim 1, wherein the panel is hinged to the housing and the means for pivoting the panel comprises a solenoid coupled between the panel and the housing for moving the panel to the open position.

5. The lighting system of claim 4, further comprising an adjustment for setting an angle of the panel in the open position, the adjustment comprising a set screw mounted between the solenoid and the panel, the set screw being adjustable in at least one direction.

6. The lighting system of claim 4, further comprising a pivoting mount for the lamp, the pivoting mount permitting adjustment of an angle of incidence of the beam toward the panel.

7. The lighting apparatus of claim 1, wherein the panel comprises a mirrored rear surface facing the lamp.

8. The lighting apparatus of claim 1, further comprising a switch means for controlling activation of the lamp when the panel is opened.

9. An emergency lighting apparatus to be recessed in a structural surface and activated during a predetermined contingency, comprising:

a panel having a rear face with a substantially reflective surface, said panel being rotatable on a pivot axis relative to the structural surface, over a recess, the panel being normally in a position flush over the recess;

an actuating arm connected between the structural surface and a point on the panel spaced from the pivot axis, and a powered actuation means for extending a length the actuating arm travels for causing the panel to rotate to an inclined position relative to the position flush over the recess;

a lamp disposed in the recess for directing an illumination beam at the panel when in the inclined position, whereupon the beam is reflected laterally by the panel; and, means for controlling the lamp and the actuation means for retracting the panel when the light is off for maintaining the apparatus in the recess, and rotating the panel while activating the lamp for providing illumination upon occurrence of the contingency.

10. The emergency lighting apparatus of claim 9 further comprising a set screw for adjusting the length the actuating arm travels.

11. The emergency lighting apparatus of claim 9, wherein the contingency includes a loss of illumination from a primary source of power, the apparatus further comprising a secondary source of power, and the means for controlling the lamp and the actuation means is operable to sense a loss of the primary source of power and to couple the actuation means and the lamp to the secondary source of power.

12. The emergency lighting apparatus of claim 11, wherein the secondary source of power comprises a battery normally charged from the primary source of power.

13. An emergency lighting fixture which remains concealed until operation of a primary lighting system fails comprising:

a housing installed within one of a wall and a ceiling and having an open front face;

a panel having an at least partly reflective rear facing surface, said panel having a first end hinged to the front face of the housing;

an arm connected between the housing and the panel by a link, the arm being actuated by a solenoid operable to extend the arm for tilting the panel;

a lamp fixedly mounted within the housing for directing a beam toward the rear facing surface of the panel;

a controller operable to power the lamp and the solenoid for concurrently moving the panel from a closed position covering the housing to an inclined open position and activating the lamp.

14. The emergency lighting fixture of claim 13, wherein the controller is operable for moving the panel and activating the lamp responsive to a loss of the primary power.

15. The emergency lighting fixture of claim 14, further comprising means for adjusting a length of the extension of the arm.

* * * * *